US009303222B2

(12) United States Patent
Keuken et al.

(10) Patent No.: US 9,303,222 B2
(45) Date of Patent: Apr. 5, 2016

(54) ENVIRONMENTALLY IMPROVED MOTOR FUELS

(75) Inventors: Hans Keuken, Wuustwezel (BE); Hendrik Cornelis de Jager, Nieuwerkerk (NL)

(73) Assignee: SHE BLENDS HOLDING B.V., Breda (NL)

( * ) Notice: Subject to any disclaimer, the term of this patent is extended or adjusted under 35 U.S.C. 154(b) by 103 days.

(21) Appl. No.: 12/865,303

(22) PCT Filed: Jan. 30, 2009

(86) PCT No.: PCT/NL2009/050044
§ 371 (c)(1),
(2), (4) Date: Aug. 30, 2010

(87) PCT Pub. No.: WO2009/096788
PCT Pub. Date: Aug. 6, 2009

(65) Prior Publication Data

US 2010/0325945 A1 Dec. 30, 2010

(30) Foreign Application Priority Data

Feb. 1, 2008 (EP) ..... 08150972

(51) Int. Cl.

| | |
|---|---|
| ***C10L 1/18*** | (2006.01) |
| ***C10L 1/10*** | (2006.01) |
| ***C10L 1/02*** | (2006.01) |
| ***C10L 1/12*** | (2006.01) |
| ***C10L 1/182*** | (2006.01) |

(Continued)

(52) U.S. Cl.
CPC . *C10L 1/10* (2013.01); *C10L 1/023* (2013.01); *C10L 1/125* (2013.01); *C10L 1/1824* (2013.01); *C10L 10/02* (2013.01); *C10L 10/08* (2013.01)

(58) Field of Classification Search
CPC ..... C10L 1/10; C10L 1/023; C10L 1/125; C10L 1/1824; C10L 10/02; C10L 10/08
USPC ..... 44/302, 451
See application file for complete search history.

(56) References Cited

U.S. PATENT DOCUMENTS 2,404,094 A * 7/1946 Robertson ..... C10L 1/023 44/451
3,822,119 A * 7/1974 Frech ..... 44/451

(Continued)

FOREIGN PATENT DOCUMENTS

| | | |
|---|---|---|
| CN | 1609424 | 4/2005 |
| DE | 3835348 | 4/1990 |

(Continued)

OTHER PUBLICATIONS

Gu Jie et al., "An Experimental Investigation on Gasoline-Ethanol Blends Fuelled Engine," Zhejiang University, English translation.

*Primary Examiner* — Cephia D Toomer
(74) *Attorney, Agent, or Firm* — Preti Flaherty Beliveau & Pachios LLP

(57) ABSTRACT

The invention is directed to the use of a combination of ethanol and water in an amount of water between 1 and 10 wt. % on the basis of the weight of the ethanol, in gasoline based motor fuel for keeping the internal and external environment of internal combustion engines cleaner then when using gasoline or ethanol-gasoline blends, having the same ethanol-gasoline ratio.

12 Claims, 1 Drawing Sheet

(51) Int. Cl.
*C10L 10/02* (2006.01)
*C10L 10/08* (2006.01)

(56) References Cited

U.S. PATENT DOCUMENTS

| | | | | | |
|---|---|---|---|---|---|
| 4,207,076 | A | * | 6/1980 | Bove et al. | 44/430 |
| 4,279,619 | A | * | 7/1981 | Tsuzuki et al. | 44/451 |
| 4,398,921 | A | | 8/1983 | Rifkin et al. | |
| 4,410,334 | A | * | 10/1983 | Parkinson | 44/451 |
| 4,801,305 | A | * | 1/1989 | Muller et al. | 44/451 |
| 2006/0048443 | A1 | * | 3/2006 | Filippini et al. | 44/301 |
| 2009/0031613 | A1 | * | 2/2009 | Sijben | 44/302 |

FOREIGN PATENT DOCUMENTS

| | | |
|---|---|---|
| GB | 2421028 | 6/2006 |
| JP | 2005187520 | 7/2005 |
| JP | 2005187706 | 7/2005 |
| JP | 2005298530 | 10/2005 |
| JP | 2006249309 | 9/2006 |
| JP | 2006249310 | 9/2006 |
| WO | WO 97/18279 | 5/1997 |
| WO | WO 02/088280 | 11/2002 |
| WO | WO 03/066781 | 8/2003 |
| WO | WO 2006/137725 | 12/2006 |

* cited by examiner

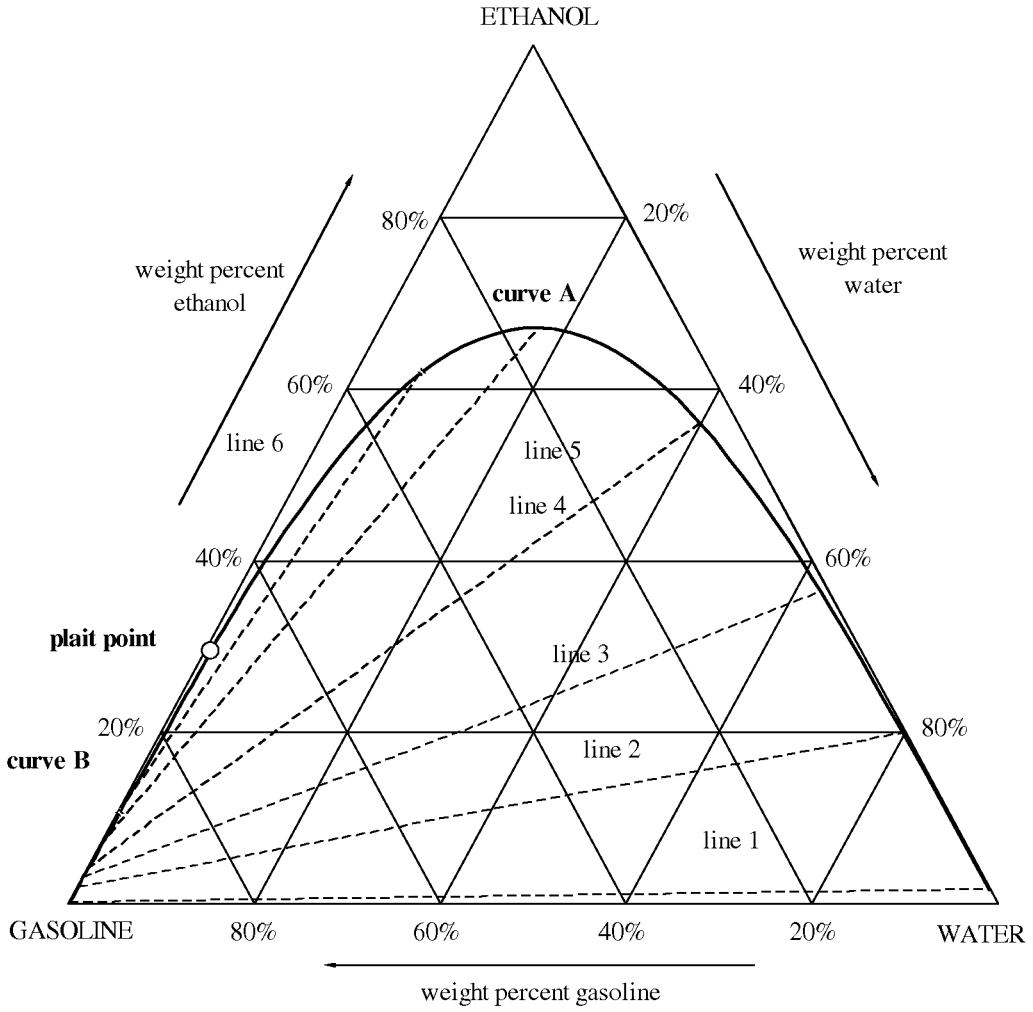
ETHANOL
80%
20%
weight percent ethanol
weight percent water
curve A
60%
40%
line 6
line 5
line 4
40%
60%
plait point
line 3
20%
80%
curve B
line 2
line 1
GASOLINE
80%
60%
40%
20%
WATER
weight percent gasoline

ENVIRONMENTALLY IMPROVED MOTOR FUELS

This invention relates to improvements in motor fuels for internal combustion engines and more in particular to improvements in relation to the on the one hand emissions from those engines and on the other hand to improving the cleanness of the interior of those engines. More in particular this invention relates to those environmental improvements in relation to the use of motor fuel compositions based on fuel blends of gasoline and ethanol.

The use of ethanol-gasoline blends as motor fuel is strongly increasing in the present period, especially in view of the decreasing stocks of oil and the need to decrease the emission of carbon dioxide. In this area there is a need for improving the efficiency of the use of these blends and more in particular in decreasing the pollution caused by the use thereof. This applies on the one hand to emissions of various noxious and greenhouse gases and on the other hand to the situation inside the internal combustion engine. Improvement in the interior of the engine and more in particular in the cleanness thereof, has a positive effect on the emission of the noxious and greenhouse gases, i.e. a decrease thereof.

One of the possibilities of improving the emissions is by careful motor management. By adapting the way the engine and the fuel injection is managed, a certain decrease of emissions may be obtained. However, in view of environmental aspects, any possible additional decrease is advantageous.

In WO 97/18279 the use of microscopic crystalline water structures is described for enhancing the combustion of fossil fuels. The effect of water is the result of a special condition, viz. an special structure, referred to as "structured water" that causes an interaction with hydrocarbons through induced dipoles, and which leads to improved combustion characteristics. Considerable effort is needed to manufacture structured water.

U.S. Pat. No. 4,398,921 describes the use of a detergent additive in gasoline, ethanol blends, also containing some water. The test described in example 1 of this document shows that the effect on deposits is caused by the claimed detergent, added for the purpose of this effect (col. 15, 55-60).

GB-A 2,421,028 is directed to a fuel that contains 0.5-8% castor oil. This component is not a regular constituent of gasoline, nor of any other mineral oil fraction. The document does not clarify whether the decreased NOx emissions and reduced fuel consumption are related to the presence of this component or the use of ethanol or water. Furthermore, the conclusions are explicitly drawn for 2-stroke engines, whereas car engines for gasoline are exclusively 4-stroke.

DE-A 38 35 348 concerns a fuel additive comprising at least four components, namely water, ethanol, n-heptane and iso-butanol.

It is an object of the present invention to improve the environmental load caused by the use of internal combustion engines.

The invention is in the broadest sense based thereon that the additional use of water in ethanol gasoline blends improves the fuel efficiency, reduces emissions of noxious and greenhouse gases, en keeps the interior of the engine cleaner than without the use of water.

The invention is directed to the use of a combination of ethanol and water in an amount of water between 1 and 10 wt. % on the basis of the weight of the ethanol, in gasoline based motor fuel for keeping the internal and external environment of internal combustion engines cleaner than when using gasoline or ethanol-gasoline blends, having the same ethanol-gasoline ratio.

In the area of ethanol gasoline motor fuels the product is generally defined as Ex, wherein x stands for the volume percentage of ethanol in the blend. E15, for example thus refers to a blend containing 15 vol. % of ethanol and E85 contains 85 vol. %. The differences between weight basis and volume basis are small.

The invention is applicable to all variations in blends, i.e. from E1 to E95, but it is preferred in the area where the amount of water is such that the liquid maintains a 'clear and bright' specification, meaning that the fuel does not have a separate liquid layer. Such blends have been described in WO 2006-137725.

Preferred ranges of ethanol are between 1 and 95 wt. % of the motor fuel. Within these ranges, more preferred are between 10 and 40 wt. % resp. 10 and 30 wt. %, as well as between 60 and 95 wt. %.

The invention results in a decrease of the emission of various gases including, but not limited to carbon dioxide, NOx, formaldehyde, acetaldehyde, oxy- and nitro-polyaromatic hydrocarbons, and the like. Further, the invention results in a better mileage (km/l) and a better engine performance, including in keeping the engine internals cleaner than without the use of water.

The invention does not rely on the use of specific water structures, such as crystalline water. Plain (non-structured or amorphous) water is used herein. Nor is the invention based on the effect of castor oil, or the use of higher alkanes such as disclosed in the references above. The effect of the use can solely be contributed to the use of a combination of ethanol and water in an amount of water between 1 and 10 wt. % on the basis of the weight of the ethanol, in gasoline based motor fuel.

As indicated above, the invention is preferably applied in the area of compositions where the motor fuel is in one phase or, at least, does not contain a separate liquid layer.

It is widely known that gasoline and water do not mix. This means that water, when added to gasoline, forms a separate liquid phase which contains virtually all the water and a very small amount of gasoline, and is generally termed the "water phase". The other phase, the "gasoline phase" contains a very small amount of water. The water phase has physical properties that are totally different from the gasoline phase. The density of the water phase at ambient conditions is typically 1000 kg/m3, whereas the density of the gasoline phase is typically 700 kg/m3. The interfacial tension between the water phase and the gasoline phase is typically 0.055 N/m. This means that droplets of the water phase in the gasoline phase have a strong tendency to coalesce. Furthermore, the density difference leads to a rapid disengagement of the two liquid phases into a lower water layer and an upper gasoline layer. The presence of a separate water layer is generally known to be harmful to systems for fuel storage and distribution, car fuel tanks, fuel injection systems and related systems.

Gasoline and anhydrous ethanol are miscible in any ratio, i.e. they can be mixed without occurrence of a separate liquid phase. When a certain amount of water is present, however, a separate liquid layer will occur. The maximum amount of water that does not cause a separate liquid layer to appear shall be known here as the "water tolerance". The occurrence of a separate liquid phase in gasohol is perceived as harmful even though the phase behavior of gasoline—ethanol—water mixtures is totally different from gasoline—water mixtures.

FIG. 1 shows a ternary liquid-liquid phase diagram. Although gasoline is a multi-component mixture, the weight percentages of all gasoline constituents have been compounded and thus the water—ethanol—gasoline mixture can be considered as a ternary mixture, i.e. a mixture of three components. All data in the diagram refer to phase equilibria at 20° C.

In the ternary diagram two curves are drawn, termed "curve A" and "curve B". Curve A runs from the water angle of the ternary diagram to the point denoted as "plait point". Curve B runs from the gasoline angle of the ternary diagram to the plait point. The area in the phase diagram below "curve A" and "curve B" is the two-liquid region. A mixture composition that falls in that region produces two liquid phases. The composition of the coexisting liquid phases is represented by the vertices of so-called "tie-lines". Six examples of such tie-lines are shown in FIG. 1 and marked "line 1" to "line 6". The amount of each of the two liquid phases can be determined from the tie-lines by the lever rule, which is known to one acquainted with phase diagrams. The point marked as "plait point" represents the composition where the length of the tie-line is zero. It should be noted that the composition of the gasoline fraction in the coexisting liquid phases will be different to some extent. The exact location of curves A and B and the slopes of the tie-lines depend on the composition of the gasoline. With this composition, the location of the plait point is as follows: 29.5 weight percent ethanol, 0.6 weight percent of water and 69.9 weight percent gasoline.

From the phase diagram it can be learned that ethanol has a strong tendency to stay in the second liquid phase. At low ethanol concentrations, which are represented by the region near the gasoline—water side of the phase diagram, practically all compositions fall in the two-liquid region, and the second liquid phase is rich in water and consequently is characterized as "water phase". In this region the physical properties of the coexisting phases are very different and they will readily disengage in a lower water phase and an upper gasoline phase. At low water concentrations, which are represented by the region near the gasoline—ethanol side of the phase diagram, the phase behavior strongly depends on the ethanol concentration. Near the plait point the composition of the two liquid phases will be rather similar and as a result the physical properties of these phases will be similar. Moving from the plait point into the direction of the water angle of the ternary diagram, the further away from the plait point, the greater will be the difference between the physical properties of the coexisting liquid phases.

Similarity in composition and physical properties will prevent a two-liquid phase system from becoming a visibly inhomogeneous mixture. Said similarity in composition and physical properties makes the system suitable for fuel with specification "clear and bright".

The fuel used in the present invention can be produced in various ways, the preferred way being the simple blending of the gasoline with hydrous ethanol. Other possibilities are the blending of the separate components, gasoline, (anhydrous) ethanol and water or of other combinations, such as wet gasoline with ethanol, to produce the required composition.

In view of stability of the composition, it is preferred to add the gasoline to the water ethanol mixture. It has surprisingly been found that this way of producing leads to a more stable and useful composition.

The phrase "anhydrous ethanol" refers to ethanol free of water. In industrial practice the European specification for the maximum water content of anhydrous ethanol is typically 0.1-0.3 percent weight. "Dehydrated alcohol" is synonym for anhydrous alcohol.

The phrase "hydrous ethanol" refers to a mixture of ethanol and water. In industrial practice, hydrous ethanol typically contains 4-5 percent weight of water. "Hydrated ethanol" is synonym for hydrous ethanol.

The phrase "gasoline" refers to a mixture of hydrocarbons boiling in the approximate range of 40° C. to 200° C. and that can be used as fuel for internal combustion engines. Gasoline may contain substances of various nature, which are added in relatively small amounts, to serve a particular purpose, such as MTBE or ETBE to increase the octane number, or isobutylalcohol (IBA) and tertiary butylalcohol (TBA) to promote phase stability.

The invention is now further elucidated on the basis of the following examples, showing the effect of water on the reduction of emissions by internal combustion engines.

EXAMPLE

In tests with gasoline that contains 15 vol % anhydrous ethanol, i.e. ethanol that contains no more than 0.3% wt of water, the fuel consumption increased by 5% (due to the lower energy content of the ethanol).

In similar tests with ethanol which contained 4 wt. % water, the fuel consumption decreased by max. 2%.

The fuel consumption in the case of the additional presence of water was accordingly substantially less (over three percent) than that with anhydrous ethanol under all driving conditions tested.

The invention claimed is:

1. A method of improving the mileage of a vehicle comprising:

providing a mixture consisting of an ethanol and a water;

wherein an amount of water in the ethanol and water mixture is between 1 and 10 wt. % on the basis of the weight of the ethanol in the ethanol and water mixture;

providing a combined motor fuel consisting of the ethanol and water mixture and a gasoline without forming a separate liquid layer thereby maintaining a clear and bright specification of the combined motor fuel without blending additives to prevent the occurrence of the separate liquid layer; and burning the combined motor fuel in an internal combustion engine of the vehicle, thereby improving the mileage thereof as compared to burning in the engine a gasoline or a gasoline-ethanol blend not including the water;

wherein an amount of ethanol in the combined motor fuel is between 60 and 95 wt. % of the combined motor fuel;

wherein the gasoline includes a mixture of a plurality of hydrocarbons, the hydrocarbons in the gasoline boiling in an approximate range of 40 C to 200 C.

2. Method for improving mileage in the use of a motor fuel comprising:

combining a mixture consisting of an ethanol and a water, wherein an amount of water in the ethanol and water mixture is between 1 and 10 wt. % on the basis of the weight of the ethanol in the ethanol and water mixture, with the motor fuel to form a combined motor fuel consisting of the ethanol and water mixture and a gasoline without forming a separate liquid layer thereby maintaining a clear and bright specification of the motor combined fuel without blending additives to prevent the occurrence of the separate liquid layer; and burning the combined motor fuel in an engine of a vehicle, improving the mileage of the vehicle as compared to burning in the engine a gasoline or a gasoline-ethanol blend not including the water;

wherein the amount of ethanol is between 60 and 95 wt. % of the combined motor fuel; and wherein the gasoline consists of includes a mixture of a plurality of hydrocarbons, the hydrocarbons in the gasoline boiling in an approximate range of 40 C to 200 C and optionally, other non hydrocarbon substances.

3. Method for decreasing overall $CO_2$ emissions in the use of a motor fuel comprising:

combining a mixture consisting of an ethanol and a water, wherein an amount of the water is between 1 and 10 wt. % on the basis of the weight of the ethanol in the ethanol and water mixture, with the motor fuel to form a combined motor fuel consisting of the ethanol and water mixture and a gasoline without forming a separate liquid layer thereby maintaining a clear and bright specification of the combined motor fuel without blending additives to prevent the occurrence of the separate liquid layer; and burning the combined motor fuel in an engine of a vehicle, decreasing the overall $CO_2$ emission of said vehicle as compared to burning in the engine a gasoline or a gasoline-ethanol blend not including the water;

wherein the amount of ethanol is between 60 and 95 wt. % of the combined motor fuel; and wherein the gasoline includes a mixture of a plurality of hydrocarbons, the hydrocarbons in the gasoline boiling in an approximate range of 40 C to 200 C.

4. Method according to claim 2, wherein:

the combination of the water and ethanol mixture with the motor fuel keeps the interior of the engine cleaner;

the combination of water and ethanol mixture with the motor fuel decreases the exhaust emission of $CO_2$, hydrocarbons, aldehydes, and oxy- and nitro-poly-aromatic compounds as compared to burning in the engine a gasoline or a gasoline-ethanol blend not including the water.

5. Method according to claim 2 or 3, wherein the combination of the water and ethanol mixture with the motor fuel decreases the exhaust emission of $CO_2$ as compared to burning in the engine a gasoline or a gasoline-ethanol blend not including the water.

6. Method according to claim 2 or 3, wherein the combination of the water and ethanol mixture with the motor fuel decreases the exhaust emission of hydrocarbons as compared to burning in the engine a gasoline or a gasoline-ethanol blend not including the water.

7. Method according to claim 2 or 3, wherein the combination of the water and ethanol mixture with the motor fuel decreases the exhaust emission of aldehydes as compared to burning in the engine a gasoline or a gasoline-ethanol blend not including the water.

8. Method according to claim 2 or 3, wherein the combination of the water and ethanol mixture with the motor fuel decreases the exhaust emission of oxy- and nitro-poly-aromatic compounds as compared to burning in the engine a gasoline or a gasoline-ethanol blend not including the water.

9. Method according to claim 2 or 3, wherein the combination of the water and ethanol mixture with the motor fuel decreases the exhaust emission of $CO_2$, hydrocarbons, aldehydes, and oxy- and nitro-poly-aromatic compounds as compared to burning in the engine a gasoline or a gasoline-ethanol blend not including the water.

10. Method according to claim 1, 2 or 3, wherein at least some of the water and ethanol mixture is in the form of hydrous ethanol.

11. Method according to claim 1, 2, or 3, further comprising adding an additional amount of the gasoline to the combined motor fuel.

12. A method of improving the mileage of a vehicle having an internal combustion engine comprising combining a mixture consisting of a hydrous ethanol consisting of an ethanol and a water in an amount of water between 1 and 10 wt. % on the basis of the weight of the ethanol in the hydrous ethanol mixture with a motor fuel to form a combined motor fuel consisting of the ethanol and water mixture and a gasoline without forming a separate liquid layer thereby maintaining a clear and bright specification of the combined motor fuel without blending additives to prevent the occurrence of a separate liquid layer;

providing the combined motor fuel available to the vehicle; and burning the combined motor fuel in the internal combustion engine of the vehicle as a way of powering the vehicle, thereby improving the mileage thereof as compared to burning in the engine a gasoline or a gasoline-ethanol blend not including the water;

wherein the amount of ethanol is between 60 and 95 wt. % of the motor fuel; and wherein the gasoline consists of a mixture of a plurality of hydrocarbons, the hydrocarbons in the gasoline boiling in an approximate range of 40 C to 200 C.

* * * * *